US005697833A

United States Patent [19]

Hislop

[11] Patent Number: 5,697,833

[45] Date of Patent: Dec. 16, 1997

[54] HAND TOOL HAVING DEBURRING AND BEVELING BIT

[76] Inventor: Gary A. Hislop, 20901 Paseo Pino, Lake Forest, Calif. 92630

[21] Appl. No.: 548,747

[22] Filed: Oct. 26, 1995

[51] Int. Cl.[6] ..... B24B 23/00

[52] U.S. Cl. ..... 451/344; 409/138; 409/349; 144/136.95

[58] Field of Search ..... 457/358, 359, 457/349, 344–348; 83/869; 29/81.01, 81.02, 81.17; 409/180, 138; 144/136.95

[56] References Cited

U.S. PATENT DOCUMENTS

| | | | |
|---|---|---|---|
| 3,360,023 | 12/1967 | Rutzebeck | 144/154.5 |
| 3,733,663 | 5/1973 | Brucker | 407/29.13 |
| 5,458,433 | 10/1995 | Stastny | 144/136.95 |
| 5,468,100 | 11/1995 | Naim | 409/138 |

FOREIGN PATENT DOCUMENTS

| | | | |
|---|---|---|---|
| 0019716 | 1/1991 | Japan | 409/197 |

*Primary Examiner*—Robert A. Rose
*Assistant Examiner*—George Nguyen
*Attorney, Agent, or Firm*—Loeb & Loeb LLP

[57] ABSTRACT

A hand tool for deburring and beveling the edge of a part includes a small, hand-held driving tool coupled to a shaft on which are mounted a rotatable cutting blade and a pair of roller bearings of conventional, cylindrical configuration on opposite sides of the cutting blade. The cutting blade is secured for rotation with the shaft by a nut mounted on a threaded outer end of the shaft to compress the inner races of the roller bearings against the cutting blade and against an annular shoulder on the shaft. Upon placement of the pair of roller bearings against opposite sides of a part having an edge to be deburred and beveled, the driving tool rotatably drives the shaft and thus the cutting blade so as to accomplish the desired deburring and beveling action. The depth of beveling along the edge of the part is determined by size and shape of the cutting blade, the diameter of the pair of roller bearings and the space therebetween. For a given spacing, the beveling depth is varied by selecting roller bearings of appropriate diameter. Conversely, for roller bearings of given diameter, the depth of beveling is selected by varying the space between the pair of roller bearings. This is accomplished by mounting one or more disk-shaped spacers on each side of the cutting blade between the cutting blade and the adjacent pair of roller bearings. The shaft with included cutting blade and roller bearings is provided as a bit assembly, with the shaft being mounted in a chuck of the driving tool.

7 Claims, 4 Drawing Sheets

HAND TOOL HAVING DEBURRING AND BEVELING BIT

BACKGROUND OF THE INVENTION

1. Field of the Invention

The present invention relates to tools for deburring and beveling the edges of parts such as metal parts, and more particularly to small, hand-held tools for deburring and beveling such parts.

2. History of the Prior Art

It is known to provide tools or machines for deburring and beveling the edges of manufactured parts. When a metal part is manufactured, for example, it is frequently the case that one or more edges of such part will be relatively sharp and may even have burrs thereon. Grinding the edges of the part using a tool having a grinding wheel or a rotating cutter blade removes the unwanted burrs and may also bevel the edge to a desired depth. As a result, the edges of the manufactured part are free of burrs and are beveled or rounded.

Some deburring and beveling tools or machines are of relatively large and heavy configuration so as to require that they be mounted on the floor, on a workbench or on other supporting structure at a work station. Such tools require that the part to be deburred and beveled be held in a particular position against the tool. The part is then moved, typically by hand, so that the desired debutring and beveling action takes place along the edges of the part. Tools of this type can be cumbersome, tend to lack versatility, and above all make it difficult to bevel the edges of the part in precise and uniform fashion. This may be partly due to the difficulty in handling large or heavy parts so that the edges thereof are run through the tool or machine in a uniform fashion.

Because of the difficulty in using large and heavy tools or machines of the stationary type, various different hand-held tools have been developed. Such tools enable the part to be mounted or simply placed on a secure work surface. The tool is then run over the edges of the part by hand. The result is a quick and relatively easy way of deburring and beveling the part edges. Examples of such hand-held tools are provided by U.S. Pat. No. 4,504,178 of Seidenfaden, U.S. Pat. No. 5,004,385 of Kishi and published U.K. Patent Application No. 2,153,726.

One approach in the design of hand-held deburring and beveling tools is to mount a rotating cutting blade between a pair of guides which are rotatable relative to the cutting blade. The guides, which may be rotatably mounted by ball bearings extending around inner and outer races thereof, are placed in contact with the opposite sides of the edge of a part to be deburred and beveled. The freely rotatable guides allow the tool to be advanced along the edge by the operator as the cutting blade rotates relative thereto at a selected speed to debur and bevel the edge.

An example of a hand-held deburring and beveling tool in which a rotating cutting blade is disposed between a pair of guides which are rotatable relative to the cutting blade is provided by U.S. Pat. No. 2,432,753 of Griffin. In Griffin, a pair of wheel guides are mounted for free rotation about a shaft projection rotatably journaled within a frame structure having a handle or gripping portion for use by the operator. A wheel element having a plurality of cutting teeth around the circumference thereof is disposed between the wheel guides so as to be coupled to the shaft projection for rotation by an external driving source.

While the tool described in the Griffin patent is capable of deburring and beveling the edge of a part with some success, such tool suffers from a number of disadvantages. Principal among such disadvantages is the fact that them is no provision for varying the depth of beveling. Instead, the guide wheels which are substantially beveled assume a fixed shape and dimensional relationship with the cutting wheel so that only a fixed depth of beveling is possible. A further disadvantage resides in the fact that the beveled guide wheels and the apparatus for rotatably mounting them are of special configuration, requiring that they be specially made just for the tool illustrated. This adds to the cost and complexity of the tool. A still further disadvantage resides in the fact that no provision is made for providing the cutting and guiding portions of the tool as a separate bit assembly for use with conventional hand-held driving tools commonly found in many machine shop environments. Instead, the tool described in Griffin is provided only as a complete unit of special configuration for coupling to an external drive source.

Accordingly, it would be desirable to provide a hand-held deburring and beveling tool capable of providing beveling to various different chosen depths with uniformity and precision. Such tool should desirably utilize conventional parts, to the extent possible, so as to eliminate the need for parts of custom configuration requiring considerable time and expense to manufacture. It would still further be desirable to provide the curing and guiding portions of such a tool in the form of a subassembly for easy attachment to and use with conventional hand-held driving tools of the type commonly found in machine shop environments.

BRIEF DESCRIPTION OF THE INVENTION

Hand-held deburring and beveling tools in accordance with the invention utilize a rotatable cutting blade or wheel in conjunction with a pair of roller bearings of conventional or standard design. The pair of roller bearings are placed on opposite sides of the cutting blade so as to be freely rotatable relative to the cutting blade and to a shaft on which the cutting blade is mounted. The like diameter of the roller bearings combines with the spacing therebetween as well as the size and shape of the cutting blade to define a particular depth of beveling. With the opposite roller bearings placed in contact with portions of a part on opposite sides of an edge of the part to be deburred and beveled, driving of the shaft rotatably drives the cutting blade to remove the burrs along the edge while at the same time beveling the edge to a desired depth.

The shaft is provided with an annular shoulder against which a first one of the roller bearings is disposed. The cutting blade is positioned against the first roller bearing opposite the annular shoulder, and the second roller bearing is positioned against the cutting blade on an opposite side of the cutting blade from the first roller bearing. Such assembly is held together by a nut mounted on a threaded outer end of the shaft opposite the annular shoulder. The nut compresses the pair of roller bearings against the cutting blade and the first roller bearing against the annular shoulder.

The roller bearings, which are of conventional design, have inner races which are longer in the axial direction than are the generally cylindrical outer races of such bearings. Accordingly, engagement of the cutting blade by the inner races of the roller bearings, and with the inner race of the first roller bearing pressed against the annular shoulder, ensures rotation of the cutting blade with the shaft. At the same time, the cylindrical outer races of the roller bearings remain free to rotate relative to the shaft.

In hand-held deburring and beveling tools according to the invention, the tool is adjustable so as to be capable of beveling to a depth which is variable. For a given curing blade size and spacing between the pair of roller bearings, the diameter of the roller bearings determines the depth of beveling. Deeper bevels are achieved by replacing the roller bearings with bearings of slightly smaller diameter. Conversely, a more shallow bevel is achieved by replacing the roller bearings with bearings of slightly larger diameter. Bearing replacement is easily and swiftly accomplished by removing the nut, sliding the pair of roller bearings and the cutting blade off of the shaft, and then returning the cutting blade to the shaft together with new roller bearings of desired diameter.

BRIEF DESCRIPTION OF THE DRAWINGS

Further objects, advantages and features of the invention will become apparent from the detailed description of a preferred embodiment when read in conjunction with the accompanying drawings, in which.

DETAILED DESCRIPTION

Figure 1:
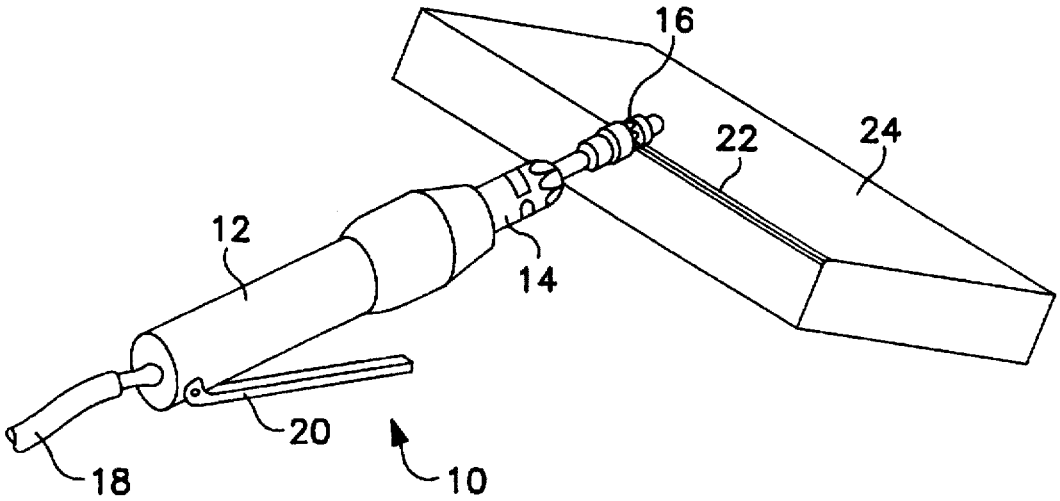
FIG. 1 is a perspective view of a hand tool having a deburring and beveling bit in accordance with the invention, as it is used to debur and bevel the edge of a part.

FIG. 1 shows a hand tool for deburring and beveling in accordance with the invention. The hand tool 10 consists of a conventional driving tool 12 having a chuck 14 for receiving a deburring and beveling bit 16. The tool 12 is of conventional design and is typical of those rotatable driving tools found in many shops. In the example of FIG. 1, the tool 12 is of the pneumatic type, and is coupled to a source of pressurized air by a hose 18. Depression of an actuating lever 20 on the tool 12 causes the tool 12 to rotatably drive the chuck 14 thereof, and thus the deburring and beveling bit 16.

As shown in FIG. 1, the hand tool 10 is being used to debur and bevel an edge 22 of a part 24. Typically, the part 24 is a manufactured metal part, but the hand tool 12 can be used to debur and bevel the edges of parts made of other materials as well.

Figure 2:
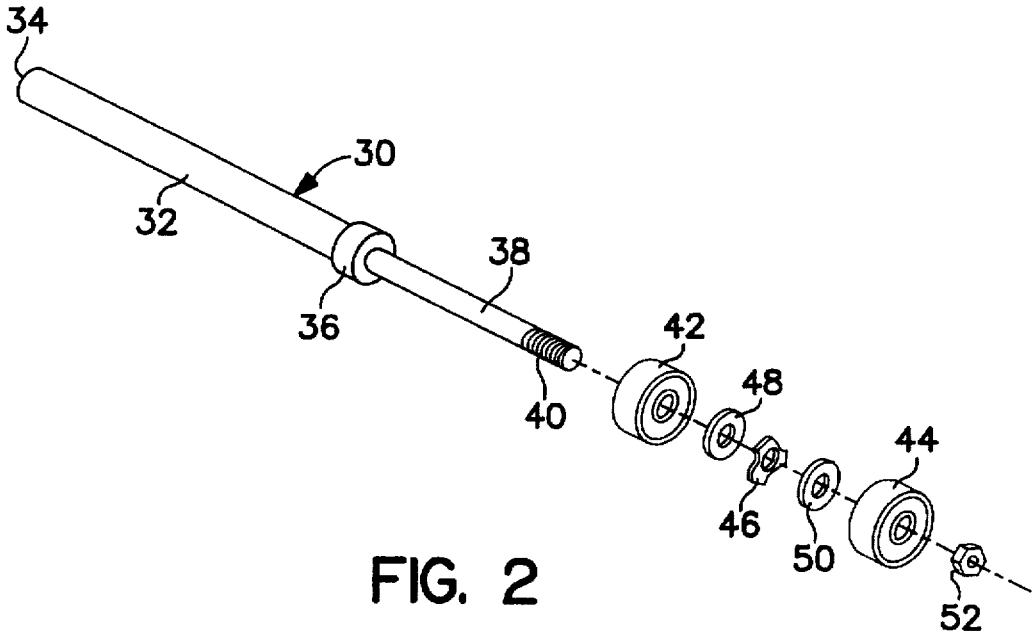
FIG. 2 is an exploded view of the bit assembly of the hand tool of FIG. 1.

The deburring and beveling bit 16 is shown in the exploded view of FIG. 2. The bit 16 includes a shaft assembly 30 comprised of a first shaft 32 having an end 34 for receipt within the chuck 14 of the tool 12. An annular shoulder 36 at an intermediate location on the shaft assembly 30 separates the first shaft 32 from a second shaft 38 of slightly smaller diameter and which has a threaded end 40 opposite the annular shoulder 36. A pair of conventional roller bearings 42 and 44 are mounted on the second shaft 38 together with a cutting blade 46. Optional spacers 48 and 50 may be included, as described hereafter. The cutting blade 46 is disposed between the roller bearings 42 and 44. Where the optional spacers 48 and 50 are used, they are disposed on opposite sides of the cutting blade 46, between the cutting blade 46 and the roller bearings 42 and 44 respectively. A nut 52 is mounted on the threaded end 40 of the second shaft 38 to secure the roller bearings 42 and 44, the cutting blade 46 and the optional spacers 48 and 50 on the second shaft 38.

Figure 3:
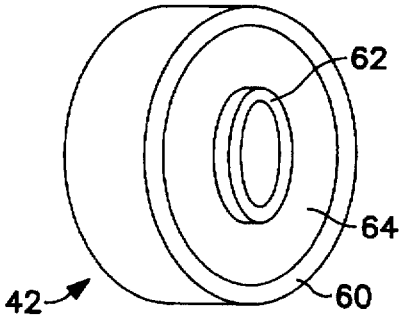
FIG. 3 is a perspective view of one of a pair of roller bearings included in the bit assembly of FIG. 2.

FIG. 3 shows the roller bearing 42. The second roller bearing 44 is identical to the first roller bearing 42, and both are standard, conventional, off-the-shelf components. As shown in FIG. 3, the roller bearing 42 includes an outer race 60, an inner race 62 and an intermediate portion 64 disclosed between the outer and inner races 60 and 62. The races 60 and 62 and the intermediate portion 64 provide the roller bearing 42 with a cylindrical configuration. The intermediate portion 64 contains either ball or roller bearings which enable the intermediate portion 64 and the outer race 60 to freely rotate relative to the inner race 62. The bearing mechanism is sealed, providing the intermediate portion 64 with flat outer surfaces on the opposite sides thereof. The outer race 60 and the intermediate portions 64 are of like length in the direction of the axis of rotation of the roller bearing 42, so that the opposite outer surfaces of the intermediate portion 64 are generally continuous with the outer race 60. The flat outer surfaces of the intermediate portion 64 seal the internal bearings and lubricant therein. The inner race 62 is of slightly greater length in the direction of the axis of rotation, compared with the outer race 60 and the intermediate portion 64. This enables the inner race 62 of each of the roller bearings 42 and 44 to be compressed together with the spacers 48 and 50 and the cutting blade 46, against the annular shoulder 36 by the nut 52, while allowing the outer race 60 of each of the roller bearings 42 and 44 to remain freely rotatable. At the same time, the compressive fit of the parts causes the cutting blade 46 to rotate with the shaft assembly 30.

Figure 4:
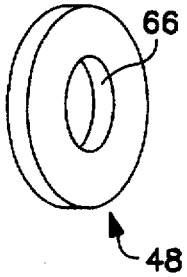
FIG. 4 is a perspective view of one of a plurality of spacers which may be included in the bit assembly of FIG. 2.

FIG. 4 shows one of the spacers 48, with the other spacer 50 being identical in configuration. As shown in FIG. 4, the spacer 48 is thin and disc-shaped in configuration and has an inner opening 66 so that it may be mounted on the shaft 38. As described hereafter, the spacers 48 and 50 are optional items which are used for some applications but not for all.

Figure 5:
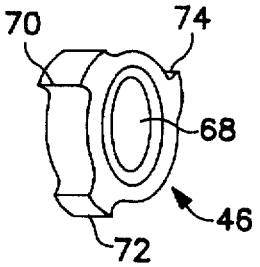
FIG. 5 is a perspective view of a cutting blade forming a part of the bit assembly of FIG. 2.

The cutting blade 46 is shown in FIG. 5. As shown therein, the cutting blade 46 has an inner opening 68 permitting it to be mounted on the shaft 38. The cutting blade 46 is configured so that the outer periphery thereof has three cutting edges 70, 72, and 74, equally spaced thereabout. In the present example, the cutting blade 46 is cast of carbide, with the three cutting edges, 70, 72, and 74 thereafter being ground to a desired sharpness. The cutting edges 70, 72, and 74 are oriented so as to performing deburring and beveling when the cutting blade 46 is rotated in a particular direction. However, operation in an opposite direction of rotation is possible simply by reversing the cutting blade 46 on the shaft 38. Also, it is possible to provide a cutting blade having the cutting edges arranged so as to be capable of deburring and beveling in either direction of rotation. It should also be understood that the particular cutting blade 46 shown in FIG. 5 is simply one example, and other configurations are possible including those in which many more than three cutting edges are provided.

Figure 6A:
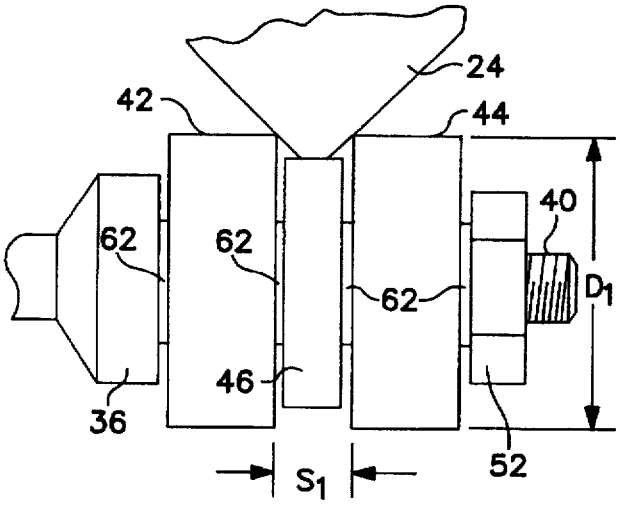
FIG. 6A is an elevational view of a part of the bit assembly of FIG. 2 illustrating the manner in which a particular depth of beveling is achieved by a particular bearing diameter and spacing between the bearings.

FIG. 6A shows the roller bearings 42 and 44 and the cutting blade 46 assembled on the shaft 38. The inner race 62 of the first roller bearing 42 engages the annular shoulder 36 at one end thereof and the cutting blade 46 at the other end thereof. The inner race 62 of the second roller bearing 44 engages the cutting blade 46 at one end thereof and the nut 52 at the other end thereof. The spacers 48 and 50 are not used in the example of FIG. 6A. Also, the cutting blade 46 is simply shown as a disc representing the outline of the cutting path defined by the rotating cutting edges 70, 72 and 74. The nut 52 is tightened on the threaded end 40 of the shaft 38 so as to compress the inner races 62 against the cutting blade 46, and against the annular shoulder 36 in the case of the first roller bearing 42. This causes the curing blade 46 to rotate with the shaft 38 and the annular shoulder 36. At the same time, the outer races 60 and the intermediate portions 64 of the roller bearings 42 and 44 are free to rotate relative to the shaft 38 and the annular shoulder 36.

The arrangement of FIG. 6A defines a space $S_1$ between the roller bearings 42 and 44, each of which has a diameter $D_1$. The dimensions $S_1$ and $D_1$ combine with the size of the cutting blade 46 to define a depth of beveling of an edge of the part 24. The roller bearings 42 and 44 contact the opposite sides of the edge being beveled, resulting in a particular depth of beveling as shown in FIG. 6A.

Figure 6B:
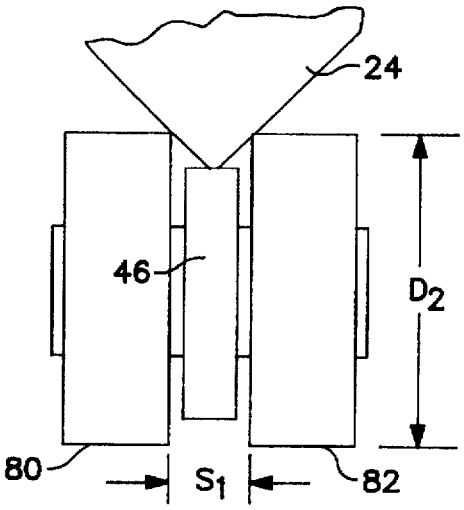
FIG. 6B is an elevational view similar to that of FIG. 6A and illustrating the manner in which a shallower bevel is produced for the same spacing between roller bearings by using bearings of slightly larger diameter.

For the given spacing $S_1$ between the roller bearings and the given size of the cutting blade 46, the depth of beveling can be decreased by increasing the diameter of the roller bearings. An example of this is shown in FIG. 6B, where the roller bearings 42 and 44 of FIG. 6A are replaced by roller bearings 80 and 82, each of which has a diameter $D_2$ slightly larger than the diameter $D_1$ in the example of FIG. 6A. With the roller bearings 80 and 82 placed against the opposite sides of the edge to be beveled on the part 24, a depth of beveling which is less than that in the example of FIG. 6A is achieved.

Figure 6C:
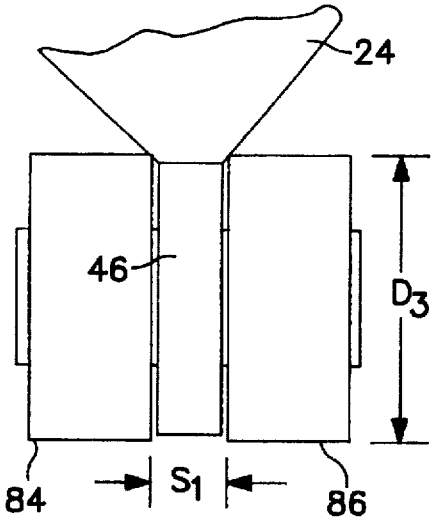
FIG. 6C is an elevational view similar to that of FIG. 6A and illustrating the manner in which a deeper bevel is produced for the given spacing between roller bearings of FIG. 6A by using bearings of slightly smaller diameter.

Alternatively, for the given spacing, $S_1$ and a cutting blade 46 of given size, the depth of beveling can be increased by using roller bearings of slightly decreased diameter. This is shown in the example of FIG. 6C, in which the roller bearings 42 and 44 of diameter $D_1$ in FIG. 6A are replaced by roller bearings 84 and 86 of diameter $D_3$ which is slightly less than the diameter $D_1$ in the example of FIG. 6A. As seen in FIG. 6C, the roller bearings 84 and 86 of smaller diameter $D_3$ provide a greater beveling depth of an edge of the part 24 when compared with the example of FIG. 6A.

The examples of FIG. 6A, FIG. 6B and FIG. 6C illustrate one method for adjusting the depth of beveling in accordance with the invention. For a given cutting blade 46 and spacing $S_1$, it is only necessary to select roller bearings of appropriate size in order to achieve a desired depth of beveling. The roller bearings are standard, off-the-shelf components, and therefore far less expensive than the custom guides required in many prior art arrangements. It is therefore easy and relatively inexpensive to stock several different sizes of the roller bearings. The nut 52 is easily and quickly removed from the threaded end 40, for replacement of the roller bearings with another pair having a diameter providing the desired depth of beveling.

Figure 6D:
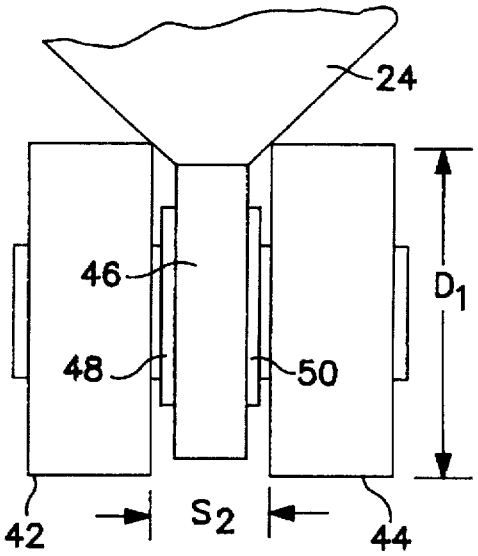
FIG. 6D is an elevational view similar to that of FIG. 6A and illustrating the manner in which a deeper bevel can be achieved with the bearing diameter and spacing of FIG. 6A by insertion of spacers between the roller bearings and the cutting blade.

An alternative method of adjusting the depth of beveling is illustrated in FIG. 6D. For the given roller bearing diameter $D_1$ of the roller bearings 42 and 44, and the given cutting blade 46, the depth of beveling may be increased by using the spacers 48 and 50. The arrangement of FIG. 6D is like that of FIG. 6A, except for the presence of the spacers 48 and 50. The presence of the spacers 48 and 50 results in a new spacing $S_2$ between the roller bearings 42 and 44 which is greater than the spacing $S_1$ in the examples of FIG. 6A, 6B, and 6C. With the roller bearings 42 and 44 engaging the opposite sides of an edge of the part 24 to be beveled, a desired depth of beveling is achieved which is greater than that in the example of FIG. 6A. It is possible to add even more of the spacers 48 and 50 so as to even further increase the depth of beveling, where desired. Use of the spacers 48 and 50 is easily and quickly accomplished by removing the nut 52 and then remounting the roller bearings 42 and 44 and the cutting blade 46 with the spacers 48 and 50 sandwiched in-between.

Figure 7A:
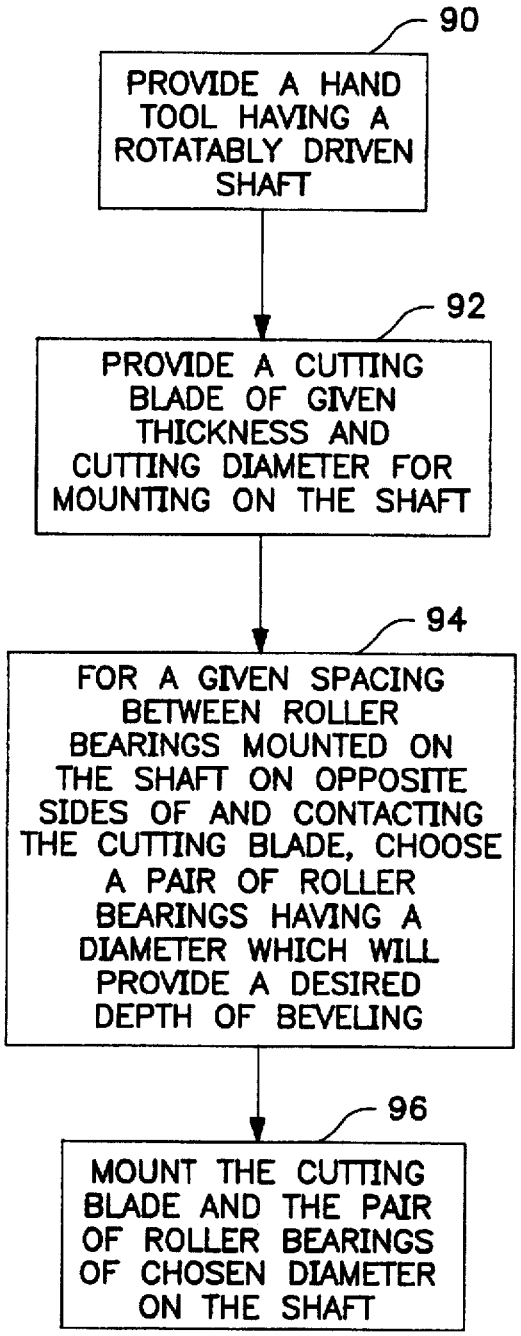
FIG. 7A is a block diagram of the successive steps in one method of adjusting the depth of beveling in accordance with the invention.

FIG. 7A is a block diagram of the successive steps in a first method of adjusting the depth of beveling in accordance with the invention, illustrated in the examples of FIG. 6A, 6B and 6C. In a first step 90, a hand tool having a rotatably driven shaft is provided. This may be accomplished by providing the tool 12 as shown in FIG. 1 with the shaft assembly 30 mounted in the chuck 14 thereof.

In a second step 92 of the method of FIG. 7A, a cutting blade of given thickness and cutting diameter is provided for mounting on the shaft assembly 30. The cutting blade may be like the blade 46 shown in FIG. 5, or it may have other dimensions or configurations.

In a third step 94 in the method of FIG. 7A, the spacing between a pair of roller bearings mounted on opposite sides of the chosen cutting blade is noted. The roller bearings are then chosen so as to have a diameter which will provided the desired depth of beveling. Thus, as previously described in connection with FIG. 6B, the roller bearings 80 and 82 of slightly larger diameter $D_2$ provide a smaller depth of beveling. Alternatively, the roller bearings 84 and 86 of slightly smaller diameter $D_3$, in the example of FIG. 6C, increase the depth of beveling.

In a final step 96 in the method of FIG. 7A, the cutting blade and the chosen pair of roller bearings are mounted on the shaft 38 and against the annular shoulder 36 by the nut 52.

Figure 7B:
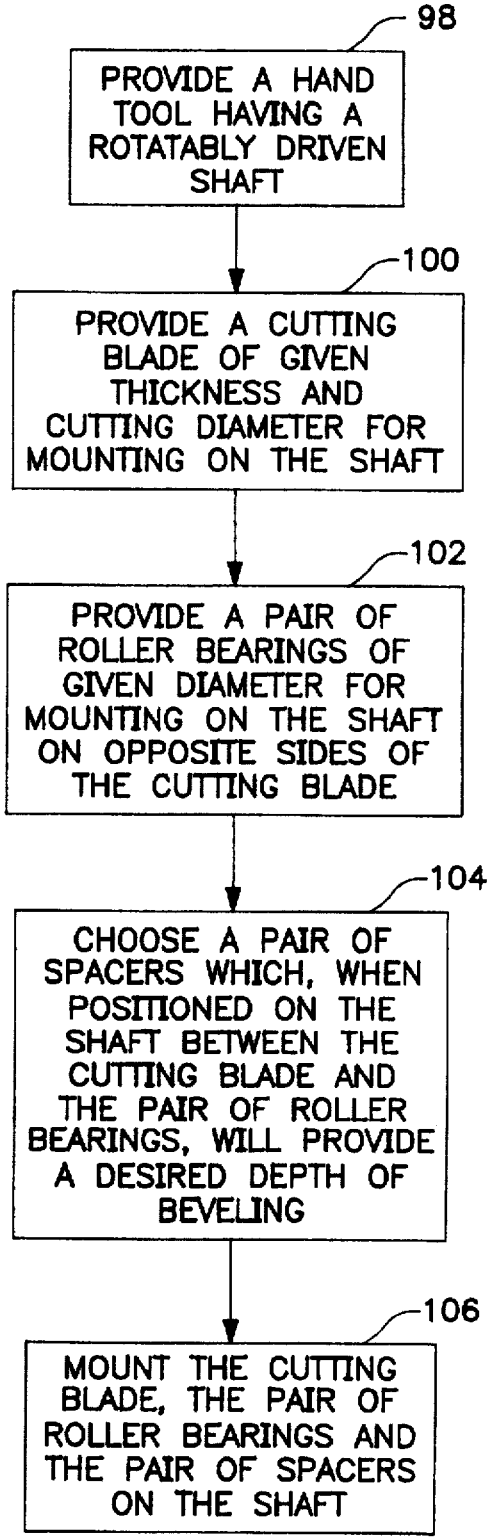
FIG. 7B is a block diagram of the successive steps in an alternative method of adjusting the depth of beveling in accordance with the invention.

FIG. 7B shows an alternative method of adjusting the depth of beveling in accordance with the invention, which relates to the example of FIG. 6D previously described. The first and second steps 98 and 100 thereof are identical to the first two steps 90 and 92 of the method of FIG. 7A. A hand tool and shaft assembly are provided, as is a cutting blade of given thickness and cutting diameter.

In a third step 102 of the method of FIG. 7B, a pair of roller bearings of given diameter are provided. Thus, in the example of FIG. 6B, the roller bearings 42 and 42 of diameter $D_1$ have been provided.

With the cutting blade 46 of given size and the roller bearings 42 and 44 of diameter of $D_1$ having been provided, a fourth step 104 in the method of FIG. 7B is performed by choosing spacers which will increase the spacing between the roller bearings so as to increase the depth of beveling. As described in connection with FIG. 6D, addition of a pair of spacers 48 and 50 may be all that is needed. Alternatively, use of several spacers or use of spacers of different thickness than that of the spacers 48 and 50 can be used to vary the spacing between the roller bearings.

Having chosen the cutting blade, the roller bearings and the spacers, then in a final step 106 of the method of FIG. 7B, the roller bearings, the cutting blade and the spacers are mounted on the shaft 38.

While the invention has been described in connection with a preferred embodiment, it will be understood that it is not intended to limit the invention thereto, but that it is intended to cover all modifications and alternative constructions within the spirit and scope of the invention as described herein.

What is claimed is:

1. A deburring and beveling bit assembly comprising the combination of:

an elongated shaft assembly having a first end for mounting in a driving tool and a second end opposite the first end;

an annular shoulder formed on an intermediate portion of the shaft assembly between the first and second ends;

a cutting blade mounted on the shaft assembly between the annular shoulder and the second end;

a pair of roller bearings of like size and of standard configuration mounted on the shaft assembly on opposite sides of the cutting blade, each of the roller bearings having a generally cylindrical outer surface, and a first one of the pair of roller bearings being disposed against the shoulder;

a fastener mounted on the second end of the shaft assembly adjacent a second one of the pair of roller bearings; and a pair of generally disk-shaped spacers mounted on the shaft assembly between opposite sides of the cutting blade and the first and second roller bearings, the pair of spacers providing a desired spacing between the pair of roller bearings to define a desired depth of bevelling produced by the cutting blade.

2. A deburring and beveling bit assembly in accordance with claim 1, further including a relatively small, hand-held driving tool coupled to the first end of the shaft assembly.

3. A deburring and beveling bit assembly in accordance with claim 1, wherein the cutting blade is of thin, circular configuration and has three angled blades generally equidistantly spaced about an outer periphery thereof.

4. A deburring and beveling bit assembly in accordance with claim 1, wherein the second end of the shaft assembly is threaded, and the fastener comprises a nut mounted on the threaded second end of the shaft assembly.

5. A deburring and beveling bit assembly in accordance with claim 1, wherein each of the pair of roller bearings has an inner race of greater axial length than an outer race thereof, and the fastener compresses the inner races of the pair of roller bearings against the pair of spacers and the inner race of the first one of the pair of roller bearings against the shoulder to ensure that the cutting blade is securely coupled to the shaft for rotation therewith.

6. A deburring and beveling bit in accordance with claim 5, wherein the inner and outer races of each of the pair of roller bearings are of generally cylindrical configuration and with the outer race having a given axial length less than the axial length of the inner race, and each of the pair of roller bearings has a sealed intermediate bearing region disposed between the outer and inner races thereof, the sealed intermediate bearing region being of generally cylindrical shape and having an axial length approximately equal to the given axial length of the outer race.

7. A deburring and beveling bit assembly in accordance with claim 1, further including at least a second pair of roller bearings of like size and of standard configuration and of different diameter than the first-mentioned pair of roller bearings, and wherein replacement of the first-mentioned pair of roller bearings by the second pair of roller bearings on the shaft assembly changes a depth of bevelling of the bit assembly.

* * * * *